United States Patent [19]

Cale

[11] 4,042,078

[45] Aug. 16, 1977

[54] RAILWAY CAR BRAKE RIGGING FULCRUM LEVER MOUNTING

[75] Inventor: Roland E. Cale, Cortland, Ohio

[73] Assignee: Schaefer Manufacturing, Inc., Pittsburgh, Pa.

[21] Appl. No.: 734,037

[22] Filed: Oct. 20, 1976

[51] Int. Cl.[2] ..... B61H 13/38

[52] U.S. Cl. ..... 188/231; 74/519; 188/52; 308/2 R; 403/119

[58] Field of Search ..... 188/49, 52, 53, 56, 188/209, 213, 231; 74/519; 308/2 R, 22; 403/52, 164, 119

[56] References Cited

U.S. PATENT DOCUMENTS

| | | | |
|---|---|---|---|
| 607,595 | 7/1898 | Baker | 74/519 |
| 3,039,786 | 6/1962 | Punches | 403/164 |
| 3,219,156 | 11/1965 | Cale | 188/231 |
| 3,378,112 | 4/1968 | Roselius et al. | 188/52 |
| 3,533,492 | 10/1970 | Campbell | 188/52 |
| 3,889,783 | 6/1975 | Sittner et al. | 188/52 |

*Primary Examiner*—Trygve M. Blix

*Assistant Examiner*—Edward R. Kazenske

*Attorney, Agent, or Firm*—Brown, Murray, Flick & Peckham

[57] ABSTRACT

The upper end of a railway car live brake lever between the axles of a car truck is pivotally connected to one end of a link that extends across the top of the adjacent axle and is pivotally connected to the lower end of a vertical fulcrum lever. The central portion of the fulcrum lever is provided with a circular opening, the wall of which is convex from side to side of the lever and forms an arc of a circle. A rigid supporting member for the fulcrum lever projects laterally from one side of the center sill of the car and has a hook at its outer end extending through the lever opening and curved away from the live lever. The hook forms an arc of a circle and has a circular cross section, the radius of the inside of the hook being substantially the same as the radius of the wall arc. The inside diameter of the lever opening is only slightly greater than the diameter of the hook in cross section, and the upper end of the fulcrum lever is formed for connection to a device for rocking that lever around the hook.

6 Claims, 7 Drawing Figures

RAILWAY CAR BRAKE RIGGING FULCRUM LEVER MOUNTING

In a common form of railway car brake rigging the lower ends of the live and dead levers, which are supported by the brake beams, are connected by a connecting rod or bottom rod. The upper end of the dead lever is anchored to the car by a link or rod extending lengthwise of the car. The upper end of the live lever is connected by a link or rod to the lower end of a fulcrum lever, the central portion of which is pivotally supported from the side of the center sill of the car. The upper end of the fulcrum lever is connected to brake-actuating means, by which that lever is swung in one direction to apply the brakes and in the opposite direction to release them. One of the problems that is encountered is to support the fulcrum lever in such a way that it will operate freely without binding, since it tends to twist as it is rocked on its support.

It is among the objects of this invention to provide in railway car brake rigging a supporting member for the fulcrum lever, which is of simple and relatively inexpensive construction, to which the lever can quickly be applied, which requires no fastener, and on which the lever can swing freely without binding.

The invention is illustrated in the accompanying drawings, in which

Figure 1:
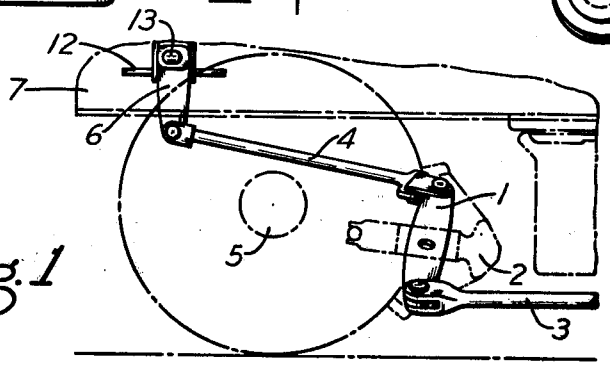
FIG. 1 is a fragmentary side view of brake rigging.

Referring to FIG. 1 of the drawings, the usual live lever 1 of railway car brake rigging is shown with its central portion pivotally supported by a conventional brake beam 2 that is supported in the usual manner (not shown) from the side frames of a car truck. The lower end of this live lever is connected by a bottom rod 3 to the lower end of the dead lever (not shown) supported by the other brake beam in the same truck. The upper end of the live lever is pivotally connected to a link 4 that extends across the adjacent axle 5 to the lower end of a substantially vertical fulcrum lever 6 supported from the center sill 7 of the car. When the upper end of this lever is swung toward the center of the car truck, the lower end of the lever pulls the upper end of the live lever to apply the brakes.

Figure 2:
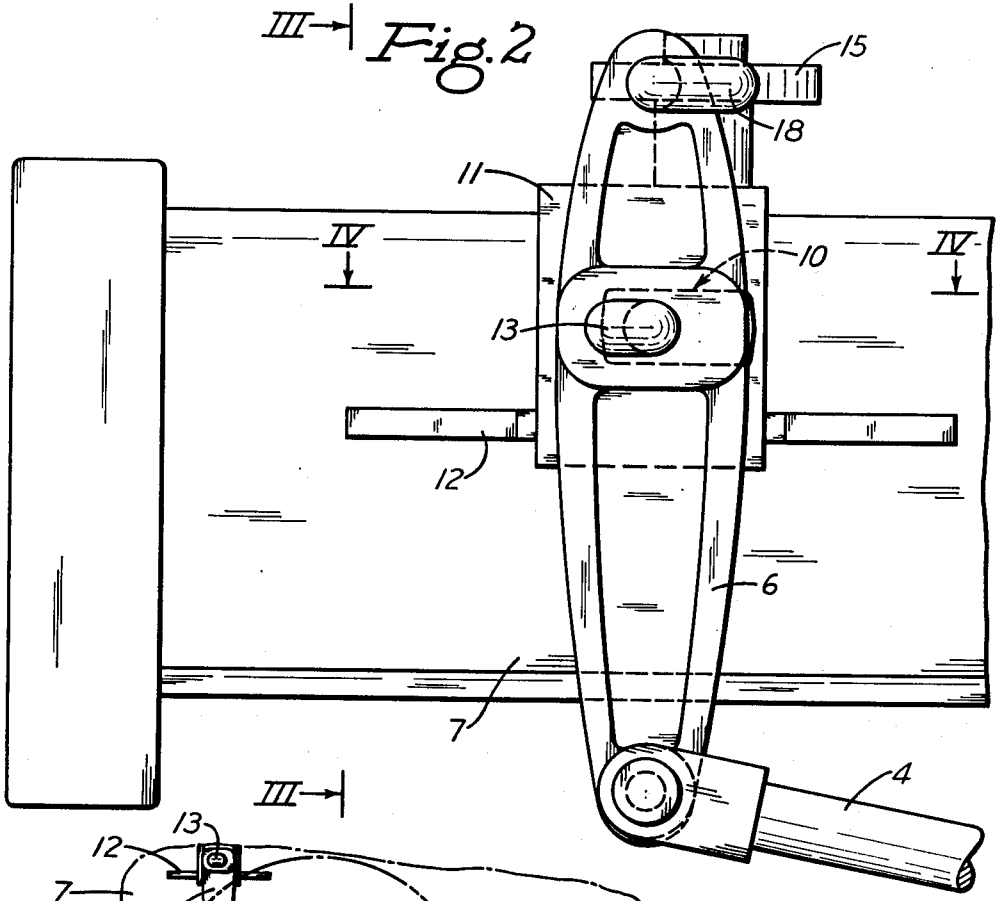
FIG. 2 is an enlarged side view of the fulcrum lever and its support.
Figure 3:
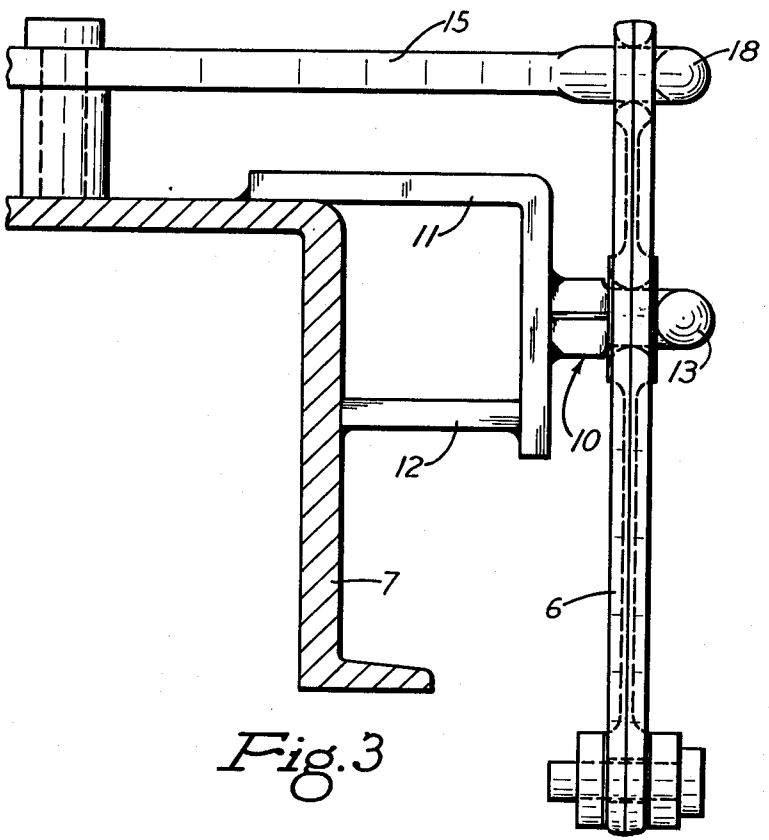
FIG. 3 is a vertical section taken on the line III—III of FIG. 2.
Figure 4:
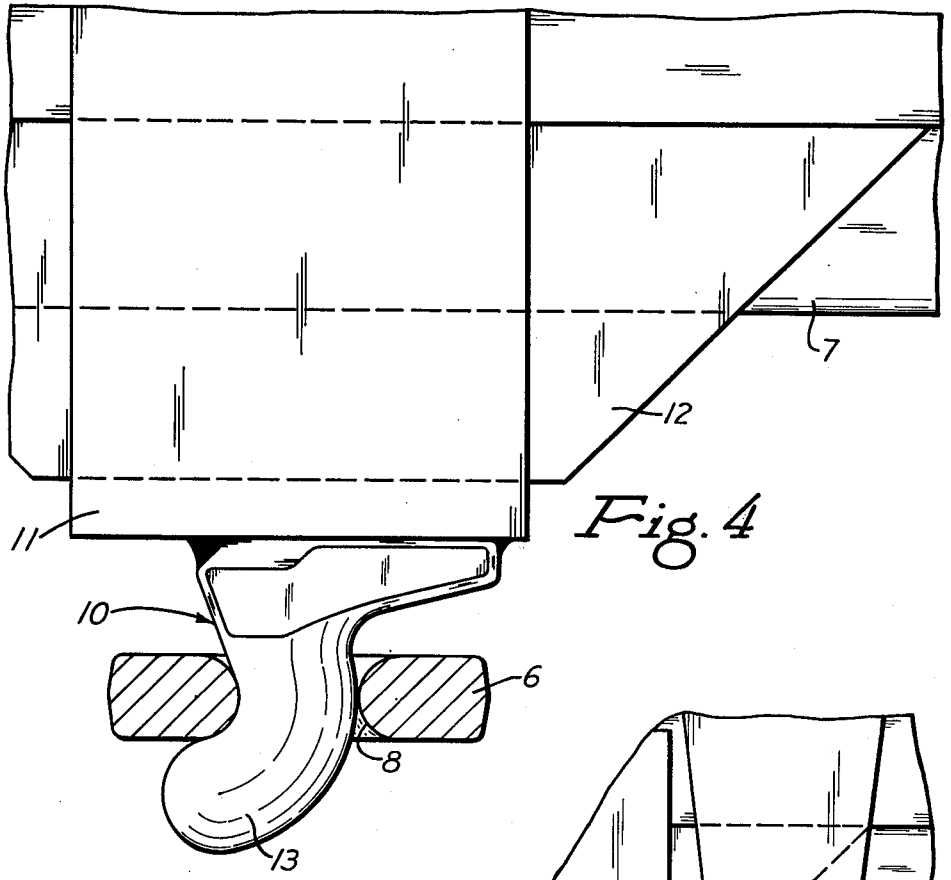
FIG. 4 is a further enlarged horizontal section taken on the line IV—IV of FIG. 2.

In accordance with this invention, the central portion of fulcrum lever 6 is provided with a circular opening 8, the wall of which is convex from side to side of the lever and forms an arc of a circle as shown in FIG. 4. To support this lever, a supporting member 10 projects laterally from the adjacent side of the center sill of the car body, as shown in FIGS. 1 to 3. This supporting member is connected to the sill by means of a bracket welded to both. The bracket includes a right angle member 11 partly overlying the sill and welded to it, and a horizontal plate 12 between the lower end of the angle member and the side of the sill and welded to them. The inner end or base of supporting member 10 is welded to the outer vertical face of this bracket. Extending laterally from one end of the base of the supporting member is an integral hook 13 that passes through the central opening in the fulcrum lever and is curved away from the live lever. This hook pivotally supports the fulcrum lever.

The hook forms an arc of a circle as shown in FIG. 4, and has a circular vertical cross section. The inside diameter of the lever opening is only slightly greater than the diameter of the hook in cross section. In other words, the lever opening in only large enough to provide enough clearance between the lever and the hook to permit the lever to be hung on the hook. The radius of the inside or concave side of the hook is substantially the same as the radius of the arc mentioned in connection with the wall of opening 8 in the fulcrum lever, whereby part of the lever fits the inside curve of the hook.

Figure 5:
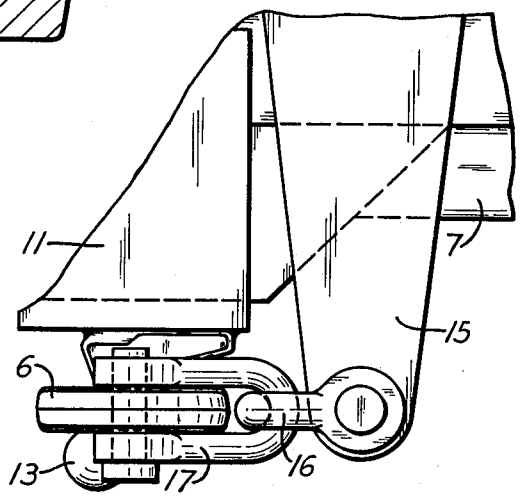
FIG. 5 is a fragmentary plan view of a modification.

The upper end of fulcrum lever 6 is connected to one end of a horizontal operating lever 15 that extends across the top of the car sill. The central portion of this lever is pivotally supported and the other end of the lever is connected in the usual manner to the air cylinder that actuates the brake rigging. The connection between the operating and fulcrum levers 15 and 6 can be by a pair of connecting clevises 16 and 17, as shown in FIG. 5, or the upper end of the fulcrum lever can be provided with a circular opening and the adjoining end of operating lever 15 provided with a hook 18 that extends through this opening as shown in FIGS. 2 and 3. In such a case, the shape of the hook and the form of the lever opening that receives it correspond to the support hook and the central opening in the fulcrum lever.

While the brake rigging is being actuated, the fulcrum lever 6 is free to turn or twist in either direction lengthwise of its supporting hook 13 the number of degrees necessary to keep it in line with the rest of the brake rigging as the brakes are applied or released, so there is no danger of the fulcrum lever binding on its support. It also will be seen that it can be quickly applied to the hook and that no pivot pins or other fasteners are required for holding it in place.

Figure 6:
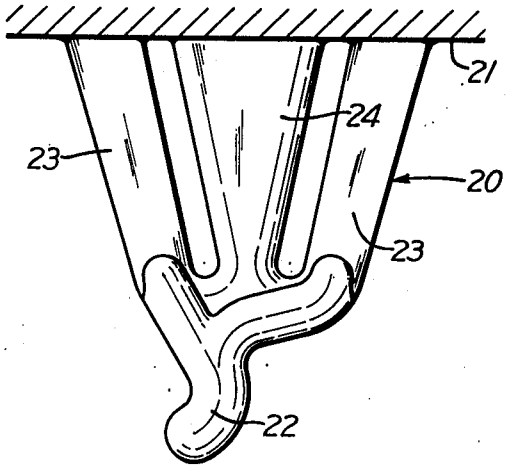
FIG. 6 is a plan view of a modified lever support.
Figure 7:
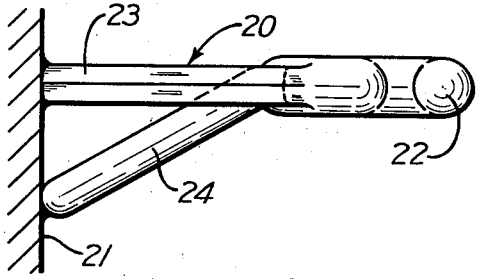
FIG. 7 is a side view of that support.

In the modification shown in FIGS. 6 and 7, there is no bracket connecting the supporting member 20 for a fulcrum lever with the center sill 21. Instead, the inner end of the supporting member is formed from three tongues extending from the hook 22 to the sill. The two outer tongues 23 are in the plane of the hook, but the center tongue 24 is longer than the outer tongues and is bent downwardly so that it slopes down toward the sill and engages it some distance below the level of the other two tongues. The free ends of the tongues are welded to the center sill. The outer tongues prevent the hook from moving lengthwise of the sill, and the center tongue braces it against vertical movement.

According to the provisions of the patent statutes, I have explained the principle of my invention and have illustrated and described what I now consider to represent its best embodiment. However, I desire to have it understood that within the scope of the appended claims, the invention may be practiced otherwise than as specifically illustrated and described.

I claim:

1. The combination with a railway car body having a center sill and supported by a truck provided with wheels mounted on a pair of axles, a live brake lever between the axles having upper and lower ends, a link pivotally connected at one end to the upper end of said lever and extending across the top of the adjacent axle, a substantially vertical fulcrum lever having a lower end pivotally connected to the opposite end of said link and having a circular opening through its central portion, the wall of said opening being convex from side to side of the fulcrum lever and forming an arc of a circle, and a rigid supporting member for the fulcrum lever projecting laterally from one side of said sill and having a hook at its outer end extending through said fulcrum lever opening and curved away from said live lever, said hook forming an arc of a circle and having a circular cross section, the radius of the inside of the hook being substantially the same as the radius of said wall arc, the inside diameter of said fulcrum lever opening being only slightly greater than the diameter of the hook in cross section, and the upper end of the fulcrum lever being formed for connection to means for rocking said fulcrum lever around said hook.

2. The combination recited in claim 1, including a bracket welded to said sill and projecting laterally from its said side, said supporting member having an inner end portion extending lengthwise of the sill and welded to said bracket.

3. The combination recited in claim 1, including a substantially horizontal operating lever above said sill and extending transversely thereof, the central portion of said operating lever being pivotally supported and one end of said operating lever being in the form of a hook, the upper end of said fulcrum lever having an upper circular opening through it, and said operating lever hook extending through said upper opening and curved toward said live lever.

4. The combination recited in claim 1, including a substantially horizontal operating lever above said sill and extending transversely thereof, the central portion of said operating lever being pivotally supported and one end of said operating lever being in the form of a hook, the upper end of said fulcrum lever having an upper circular opening through it, and said operating lever hook extending through said upper opening and curved toward said live lever, the wall of said upper opening being convex from side to side of the fulcrum lever and forming an arc of a cricle, and said operating lever hook forming an arc of a circle and having a uniform circular cross section, the radius of the inside of the operating lever hook being substantially the same as the radius of said last-mentioned arc, and the inside diameter of said upper opening being only slightly greater than the diameter of the operating lever hook in cross section.

5. The combination recited in claim 1, said supporting member having an inner portion formed from three tongues extending toward said sill from said hook, and the center tongue being longer than the others and inclined from the hook downwardly toward the sill, the free ends of said tongues being welded to the sill.

6. In combination, a substantially vertical fulcrum lever for railway car brake rigging, a lower end of said lever being formed for connection to a link connected to an upper end of a live brake lever, said fulcrum lever being provided with a circular opening through its central portion, the wall of said opening being convex from side to side of the fulcrum lever and forming an arc of a circle, and a supporting member for the fulcrum lever adapted to project laterally from one side of a railway car sill and having a hook at its outer end extending through said lever opening and curved away from said live lever, said hook forming an arc of a circle and having a circular cross section, the radius of the inside of the hook being substantially the same as the radius of said wall arc, the inside diameter of said fulcrum lever opening being only slightly greater than the diameter of the hook in cross section, and the upper end of the fulcrum lever being formed for connection to means for rocking said fulcrum lever around said hook.

* * * * *